US007297022B2

(12) United States Patent
Pearce

(10) Patent No.: US 7,297,022 B2
(45) Date of Patent: Nov. 20, 2007

(54) CEILING FAN HANGING SYSTEM

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 267 days.

(21) Appl. No.: 11/145,029

(22) Filed: Jun. 2, 2005

(65) Prior Publication Data

US 2006/0274519 A1 Dec. 7, 2006

(51) Int. Cl.
*H01R 13/60* (2006.01)

(52) U.S. Cl. ..... 439/537

(58) Field of Classification Search ..... 439/537; 362/147, 647

See application file for complete search history.

(56) References Cited

U.S. PATENT DOCUMENTS

| | | | | |
|---|---|---|---|---|
| 1,412,748 | A | 4/1922 | McKay | |
| 3,218,448 | A | 11/1965 | Cala | |
| 3,798,584 | A | 3/1974 | Person | 339/14 R |
| 4,219,870 | A | 8/1980 | Haraden et al. | 362/226 |
| 4,222,093 | A | 9/1980 | Garcia et al. | 362/147 |
| 4,300,188 | A | 11/1981 | Addario | 362/226 |
| 4,368,506 | A | 1/1983 | Rapp | 362/147 |
| 4,449,168 | A | 5/1984 | Ewing | 362/404 |
| 4,721,480 | A * | 1/1988 | Yung | 439/527 |
| 4,837,669 | A | 6/1989 | Tharp et al. | 362/418 |
| 4,929,187 | A | 5/1990 | Hudson et al. | 439/334 |
| 5,341,276 | A | 8/1994 | Shen | 362/226 |
| 5,351,174 | A | 9/1994 | Ewing | 362/226 |
| 5,562,341 | A | 10/1996 | Strauss | 362/226 |
| 5,727,865 | A | 3/1998 | Caldwell | 362/80 |
| 6,217,363 | B1 * | 4/2001 | Takata | 439/342 |
| 6,322,232 | B1 | 11/2001 | Oliver | 362/147 |
| 7,105,744 | B1 * | 9/2006 | Kwong et al. | 174/58 |

FOREIGN PATENT DOCUMENTS

GB 2481 * 5/1908

* cited by examiner

*Primary Examiner*—Neil Abrams
(74) *Attorney, Agent, or Firm*—Baker Donelson

(57) ABSTRACT

A ceiling fan hanging system (10) is disclosed for use with a conventional ceiling fan (11). The hanging system includes a ceiling mounting plate (17), a canopy mounting plate (18), a canopy (19), and a canopy trim ring (20). A male electrical connector (32) is fixedly mounted to the ceiling mounting plate. The male electrical connector which mates with the female electrical connector (51) is mounted to a slide (46) mounted for reciprocal movement upon the canopy mounting plate. The slide has two arm (47) and a central push plate or tab (48). Each arm is configured to be releasably received within a mounting plate loop (27) extending from the ceiling mounting plate and extending through a loop opening (43). The structural electrical wires are electrically coupled to the male electrical connector while the ceiling fan electrical wires are electrically coupled to the female electrical connector. The ceiling fan is mounted to the ceiling in an efficient manner by engaging the slide and moving the female electrical connector into electrical contact with the male electrical connector.

14 Claims, 3 Drawing Sheets

CEILING FAN HANGING SYSTEM

TECHNICAL FIELD

This invention relates to ceiling fans and specifically to a system for quickly mounting and connecting a ceiling fan to a ceiling and existing electrical wiring.

BACKGROUND OF THE INVENTION

Traditionally, ceiling fans have been installed by a laborious, time consuming and often cumbersome practice. The conventional ceiling fan includes a ceiling plate which is secured to an electric outlet box by passing the lead wires of the outlet box through a central circular opening in the ceiling plate. Mounting screws are passed through two elongated openings in the ceiling plate to threadingly engage with two threaded holes diagonally separated from each other on the periphery of the outlet box. Alternatively, wood screws are passed through the ceiling plate and the outlet box and into a wood stud which supports the outlet box. In either event, the screws are tightened until the ceiling plate is securely mounted on the outlet box. The typical ceiling plate includes a hanging hook.

When a typical ceiling fan assembly is mounted to the ceiling plate, the motor, fan blades and an optional light assembly are secured to a canopy by a down rod or hanger rod. The down rod passes through a central opening in the canopy with a ball mount located at an end of the down rod engaged by a periphery of the opening of the canopy. A radially inwardly extending prong projecting from the periphery of the opening of the canopy engages a slot in the ball mount to allow pivoting of the fan assembly with respect to the canopy.

The canopy includes at each of two opposite locations, a hole and an L-shaped groove. When assembled, the fan assembly is lifted by the canopy so that one hole on one side of the canopy is fitted through the free end of the ceiling hook. The fan assembly is thereby suspended from the ceiling hook.

The electrical lead wires from the ceiling plate are then connected to the lead wires from the fan motor. When the electrical connections are completed, a screw is installed in each of the two screw holes located on opposite sides of the ceiling plate.

The installer of the fan assembly, who is usually positioned at an elevated height by a ladder or some other means, must then lift the entire fan assembly and free the fan assembly from the ceiling plate by removing the canopy from engagement with the free end of the ceiling hook. The amount of allowable movement of the fan assembly is limited by the connection of the electrical wire leads. Therefore, only a small amount of movement of the fan assembly is possible before strain is placed on the connections of the wire leads.

The canopy and fan assembly are lifted until the L-shaped grooves on opposite sides of the canopy are fitted over the shanks of the screws secured in the opposite sides of the ceiling plate. The canopy is at first lifted vertically until the shank of each screw engages the bottom of the portion of the L-shaped groove which is initiated at the uppermost edge of the canopy. The canopy and therefore the entire fan assembly is then twisted so that the shanks of the screws in the ceiling plate slide in the remaining portion of the L-shaped grooves in the canopy.

The canopy of the fan assembly is twisted until the holes at the opposite sides of the canopy are aligned with the two remaining screw holes in the opposite sides of the ceiling plate. A third and fourth screw are inserted, respectively, through the opposite sides of the canopy and into the ceiling plate to anchor the canopy and thus the entire fan assembly on the ceiling plate and suspend the fan from the ceiling.

Accordingly, it is seen that a need has long existed for a ceiling light mounting system that could be more easily and quickly mounted a ceiling fan. It thus is to the provision of such that the present invention is primarily directed.

SUMMARY OF THE PRESENT INVENTION

In a preferred form of the invention, a ceiling fan hanging system for a ceiling fan having an electric motor with electric wiring to a structure having electric wiring comprises a ceiling mounting plate, a canopy mounting plate, coupling means for coupling the ceiling mounting plate to the canopy mounting plate, electrical connecting means for electrically connecting the electric wires of the ceiling fan motor to the electric wires of the structure, and a canopy adapted to be mounted to the canopy mounting plate. The electric connecting means includes a slide moveably mounted to the canopy mounting plate, a first electrical connector mounted to the slide, and a second electrical connector mounted to the ceiling mounting plate and configured to mate with the first electrical connector. The slide is moveable between a disengaged position wherein the first connector is disengaged from the second connector and an engaged position wherein the first connector is electrically engaged with the second connector.

DETAILED DESCRIPTION OF THE PREFERRED EMBODIMENTS

Figure 1:
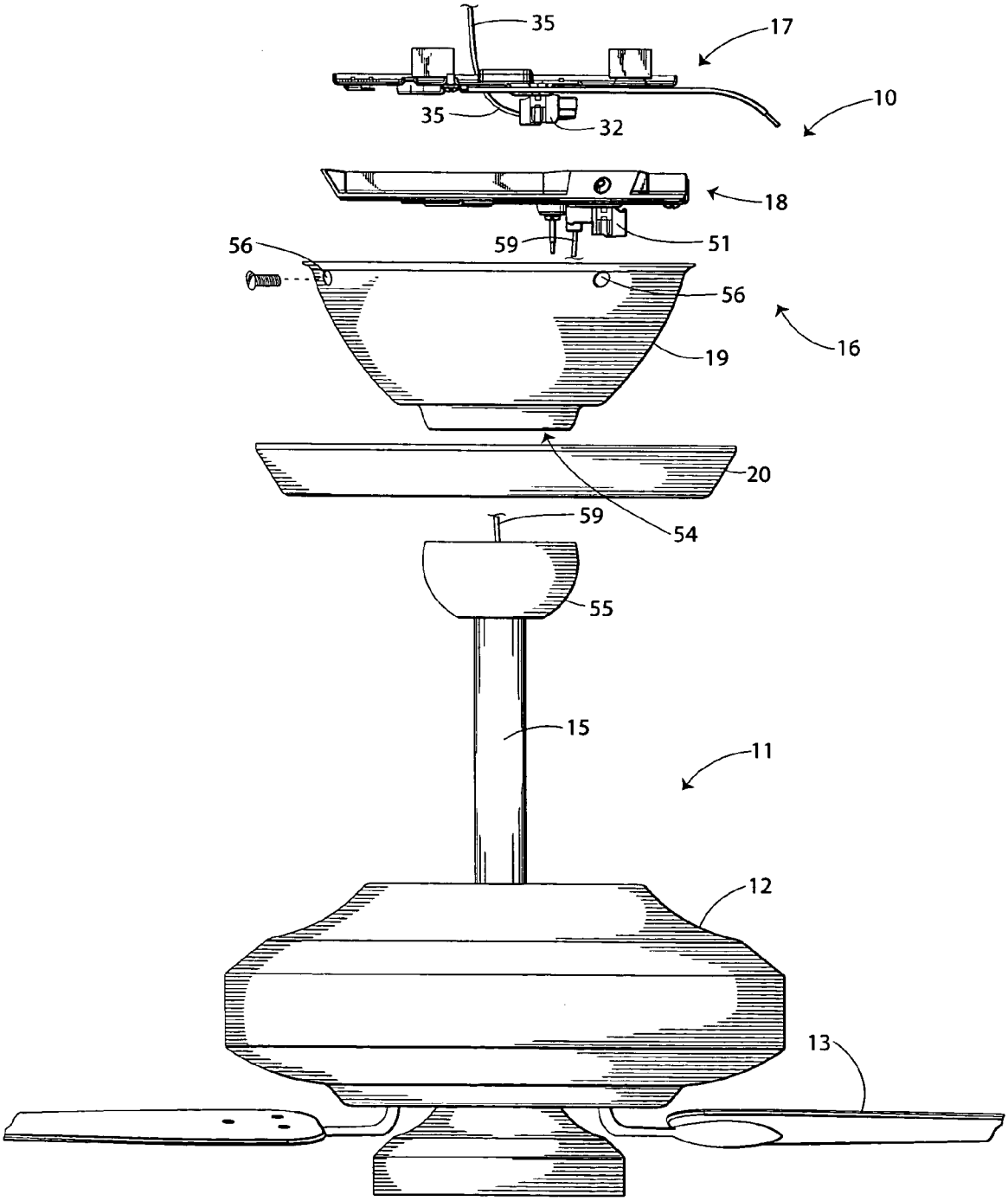
FIG. 1 is a side view of the hanging system and ceiling fan in a preferred form of the invention.
Figure 2:
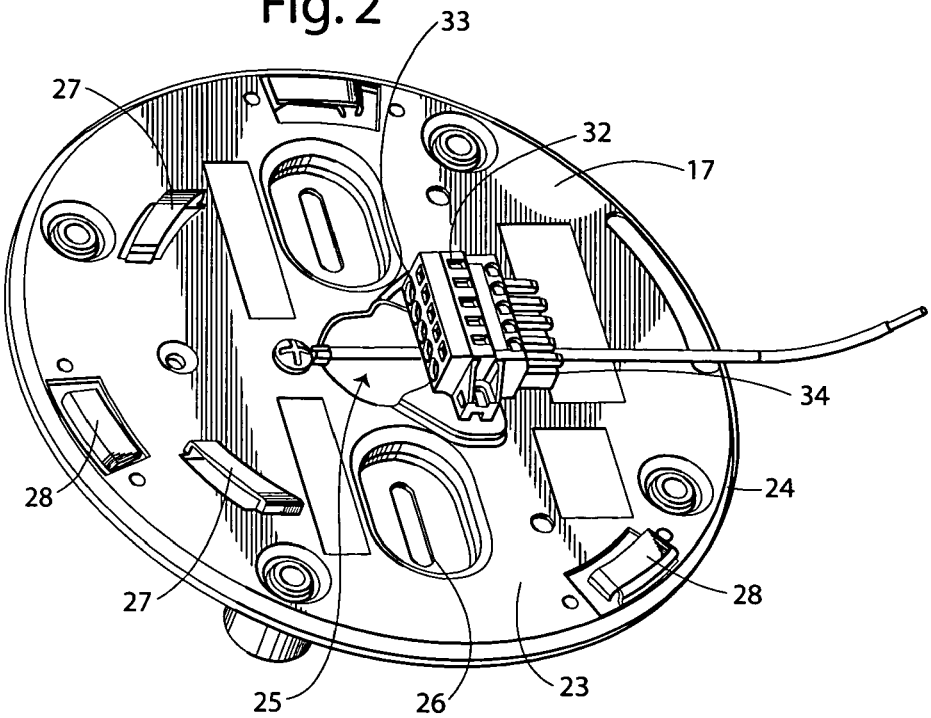
FIG. 2 is a perspective view of the ceiling mounting plate.
Figure 3:
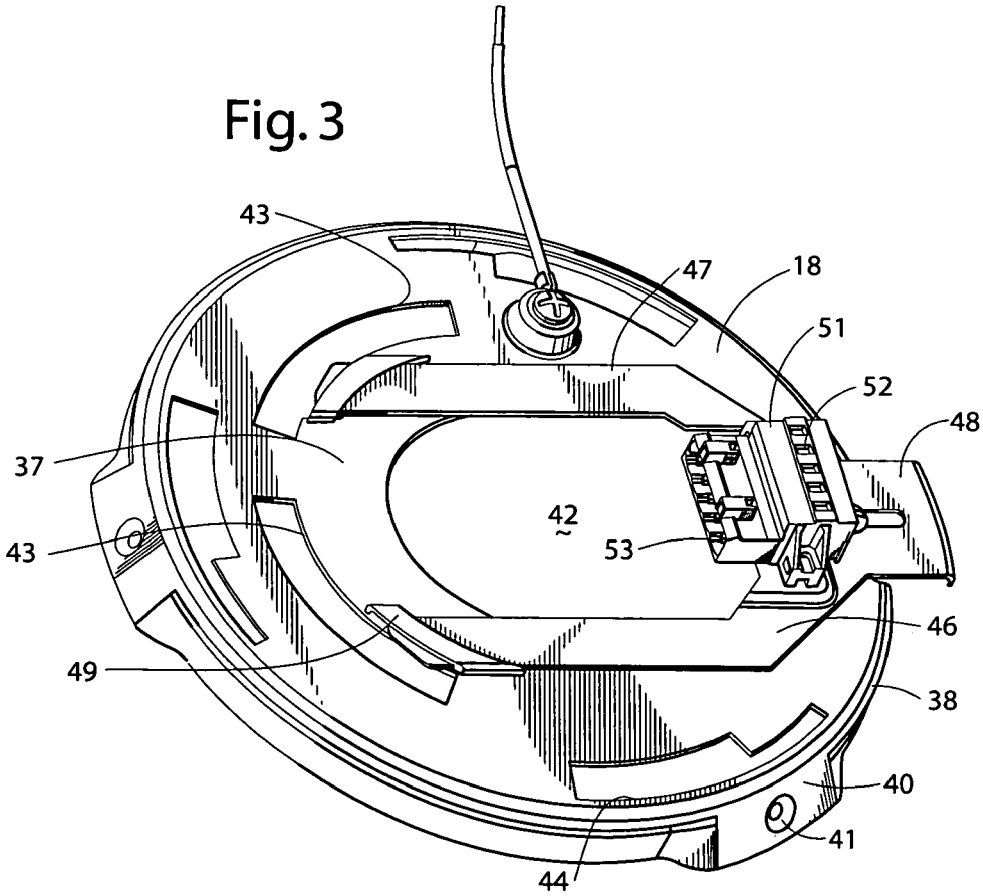
FIG. 3 is a perspective view of the ceiling mounting plate and canopy mounting plate with a slide in a disengaged position.
Figure 4:
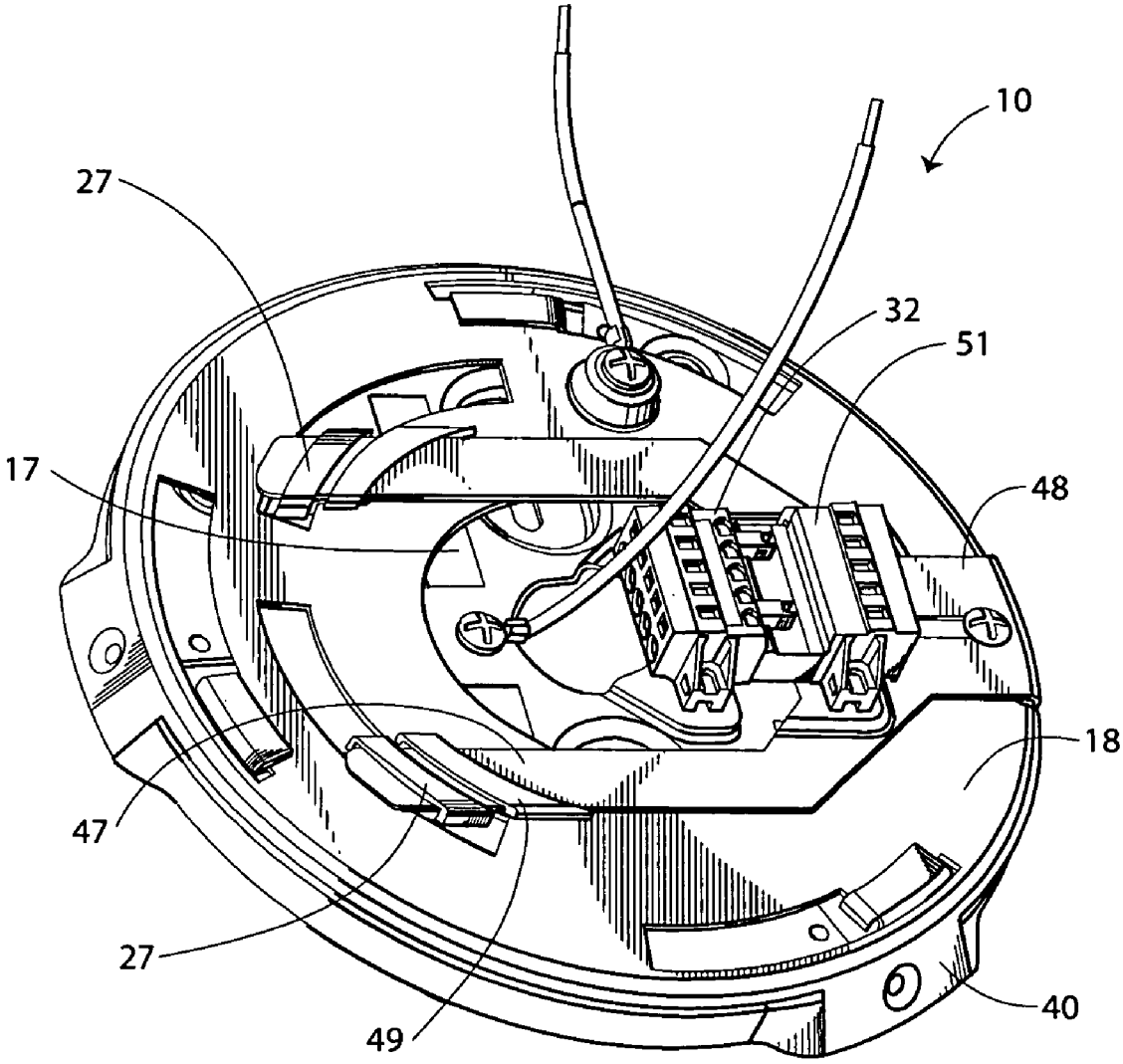
FIG. 4 is a perspective view of the ceiling mounting plate and canopy mounting plate with a slide in an engaged position.

With reference next to the drawings, there is shown a ceiling fan hanging system 10 in a preferred form of the invention which is adapted to be utilized with a conventional ceiling fan 11. The ceiling fan 11 includes a fan motor housing 12, a plurality of fan blades 13 to the motor, and a switch housing to which an optional light kit may be mounted. A downrod 15 extends from the motor in the motor housing to the ceiling fan canopy assembly 16 which includes the hanging system 10.

The canopy assembly 16 includes a ceiling mounting plate 17, a canopy mounting plate 18, a canopy 19, and a canopy trim ring 20. The ceiling mounting plate 17 has a generally planar central surface 23 and a peripheral rim 24. The central surface 23 has a central opening 25 therethrough, two elongated mounting slots 26, two loops 27, and three L-shaped mounting hooks or tabs 28. A mounting screw is passed through each mounting slot 26. A male electrical connector 32 is fixedly mounted to the central surface 23. The male electrical connector 32 has five wire receivers 33 corresponding with five prongs 34. Each wire receiver 33 includes an unshown set screw that fixes the position of an electrical wire 35 mounted within the wire receiver 33.

The canopy mounting plate 18 is configured to be mounted flush with and about the ceiling mounting plate 17. The canopy mounting plate 18 also includes a generally planar central surface 37 and a peripheral rim 38. The peripheral rim 38 includes three canopy mounting brackets 40, each having a screw mounting hole 41 therein. The central surface 37 has a central opening 42 therethrough configured to allow the passage of the female electrical connector 32 and unobstructed access of the mounting plate central opening 25, two loop openings 43 configured to allow the passage of the mounting plate loops 27 therethrough, and three hook openings 44 therethrough configured to allow the passage of the ceiling mounting plate hooks 28 therethrough. A Y-shaped slide 46 is mounted to the canopy mounting plate for reciprocal movement. The slide 46 has two arm 47 and a central push plate or tab 48. Each arm 47 is configured to be releasably received within a mounting plate loop 27 extending through a loop opening 43. The slide 46 is mounted for reciprocal movement relative to the central surface 37 through four U-shaped guides 49 extending from the central surface 37. A female electrical connector 51 is mounted to the slide 46. The female connector 51 has five electrical wire receivers 52 and five prong receivers 53 configured to receive or mate with the five prongs 34 of the male electrical connector 32. Again, the wire receivers 52 include unshown set screws. The reciprocal movement of the slide 46 moves the female electrical connector 51 between an disengaged position wherein the prong receivers 53 are disengaged from the male connector prongs 34 and an engaged position wherein the prong receivers 53 are electrically engaged with the male connector prongs 34.

The canopy 19 includes a central opening 54 which is preferably trilobular in shape to received a trilobular ball 55 coupled to the end of the downrod 15. The canopy 19 also has three screw mounting holes 56 which are alignable with the three screw mounting holes 41 of the canopy mounting plate 18. Three screws 57 pass through the canopy mounting holes 56 and are threaded into the screw mounting holes 41 of the canopy mounting plate 18 to secure the canopy 19 to the canopy mounting plate 18.

The canopy trim ring 20 is configured to fit about the top end of the canopy 19 in order to hide the canopy mounting screws 57 from view. The trim ring 20 has an internally extending resilient flange which is snap fitted over the top edge of the canopy to maintain its position relative to the canopy.

In use, with the downrod 15 extending through the central opening 54 of the canopy 19, the canopy 19 is mounted to the canopy mounting plate 18 through the use of the three mounting screws 57. The electrical wires 59 from the motor and optional light kit which extend through the downrod and ball are mounted within the wire receivers 52 of the female electrical connector 51 and secured with the set screws. It should be understood that these wires 59 may be secured in the manufacturing facility so that an installer need not do so. Similarly, the canopy may be mounted to the canopy mounting plate through the three screws 57 at the manufacturing facility.

The ceiling mounting plate 17 is mounted to the outlet box by two screws which extend through the ceiling mounting plate slots 26 and into either the outlet box or into a ceiling joist. The electrical wires 35 of the structure or building are mounted within the wire receivers 33 of the male electrical connector 32.

With the Y-shaped slide 46 in its disengaged position, the combined canopy 19 and canopy mounting plate 18, with its associated fan assembly, is lifted to a position wherein the three canopy mounting plate hooks 28 pass through the three hook openings 44. The combined canopy and canopy mounting plate is then rotated relative to the ceiling mounting plate 17 so that the ceiling plate hooks 28 ride upon and engage the canopy mounting plate central surface 37, the portion of the canopy mounting plate which engages the hook may be referred to as a hook receiver. This engagement of the hook 28 maintains the relative positions of the two plates 17 and 18 and restricts the combined canopy and canopy mounting plate from falling.

With the combined canopy and canopy mounting plate in place, the Y-shaped slide 46 is slid in an inboard direction to its engaged position. This movement of the slide 46 is accomplished by the installer simply pushing upon the central push tab 48, thereby causing the slide arms 47 to be extended through the loops 27 of the ceiling mounting plate. It should be noted that if the canopy mounting plate 18 is not resting in its fully rotated position the slide arms 47 will not extend through the loops 27, thereby indicating to the installer that the canopy mounting plate is not properly positioned. The proper passing of the slide arms 47 into the loops 27 prevents the counter rotation and thereby separation of the canopy mounting plate 18 from the ceiling mounting plate 17. Further inboard movement of the slide 46 causes the female electrical connector prong receivers 53 to receive within the prongs 34 of the male electrical connector 32, i.e. further movement of the slide electrically couples the female and male electrical connectors together. Hence, the slide first interlocks the canopy mounting plate to the ceiling mounting plate then causes an electric coupling of the structural electric wires to the motor and optional light kit electrical wires.

Once the electric connectors 32 and 51 are electrically coupled together the canopy trim ring 20 is raised to a position over the top end of the canopy wherein the trim ring flange is snap fit over the top edge of the canopy. This positioning of the trim ring obscures from view the mounting screws 57 and the slide push tab 48.

The fan may be unmounted or otherwise removed from the ceiling by simply reversing the just described process.

It thus is understood that the ceiling fan may be substantially pre-wired prior to mounting of the ceiling fan. As such, during the installation procedure the installer need only lift the ceiling fan for a very short time period during the rotational coupling of the canopy mounting plate 18 to the ceiling mounting plate. Furthermore, the electrical connection is accomplished quickly and safely through the coupling of the female and male connectors.

It should be understood that the relative positions of the hooks and hook openings may be reversed, i.e., the ceiling mounting plate 17 may include the hooks while the canopy mounting plate 18 includes the hook openings.

It thus is seen that a ceiling fan hanging system is now provided that overcomes problems associated with the prior art. It should be understood that many modifications may be made to the specific preferred embodiment described herein without departure from the spirit and scope of the invention as described by the following claims.

The invention claimed is:

1. A ceiling fan hanging system for a ceiling fan having an electric motor with electric wiring to a structure having electric wiring, the hanging system comprising:

a ceiling mounting plate;

a canopy mounting plate;

coupling means for coupling said ceiling mounting plate to said canopy mounting plate;

electrical connector means for electrically connecting the electric wires of the ceiling fan motor to the electric wires of the structure, said electric connecting means including a slide moveably mounted to said canopy mounting plate, a first electrical connector mounted to said slide, and a second electrical connector mounted to said ceiling mounting plate and configured to mate with said first electrical connector, said slide being moveable between a disengaged position wherein said first connector is disengaged from said second connector and an engaged position wherein said first connector is electrically engaged with said second connector; and a canopy adapted to be mounted to said canopy mounting plate.

2. The ceiling fan hanging system of claim 1 wherein said ceiling mounting plate includes a slide receiver configured to receive a portion of said slide while in its engaged position, whereby relative movement between the ceiling mounting plate and the canopy mounting plate is prevented by the engagement of the slide within the receiver.

3. The ceiling fan hanging system of claim 1 wherein said coupling means includes a hook and a hook receiver.

4. The ceiling fan hanging system of claim 3 wherein said hook extends from said ceiling mounting plate.

5. The ceiling fan hanging system of claim 1 further comprising a canopy trim ring configured to be mounted about a portion of said canopy.

6. A ceiling fan hanging system for a ceiling fan having an electric motor with electric wiring to a structure having electric wiring, the hanging system comprising:

a ceiling mounting plate;

a canopy mounting plate assembly including a canopy mounting plate, a canopy coupled to said canopy mounting plate, and a slide mounted for reciprocal movement relative to said canopy mounting plate, said slide being movable between a disengaged position wherein said slide is disengaged from said ceiling mounting plate and an engaged position wherein said slide is engaging said ceiling mounting plate to prevent relative movement between said canopy mounting plate and said ceiling mounting plate, and an electrical connector having a first portion electrically coupled to the electric wiring of the structure and mounted to said ceiling mounting plate and a second portion electrically coupled to the electric wiring of the ceiling fan motor and mounted to said slide, said first portion being releasably mounted and electrically coupled to said second portion, whereby the electrical connector first portion may be moved into and out of electrical contact with the second portion through reciprocal movement of the slide.

7. The ceiling fan hanging system of claim 6 wherein said ceiling mounting plate includes at least one loop for engaging contact with said slide.

8. The ceiling fan hanging system of claim 6 wherein said ceiling mounting plate includes at least one mounting hook and wherein said canopy mounting plate includes at least one hook receiver configured to receive said mounting hook.

9. A ceiling fan hanging system for a ceiling fan having an electric motor with electric wiring to a structure having electric wiring, the hanging system comprising:

a ceiling mounting plate;

a canopy assembly coupled to said ceiling mounting plate;

an electrical connector having a first portion fixedly mounted to said ceiling mounting plate and a second portion movable mounted to said canopy assembly between a disengaged position wherein said first portion is disengaged from said second portion and an engaged position wherein said first portion is electrically engaged with said second portion.

10. The ceiling fan hanging system of claim 9 wherein said canopy assembly includes a canopy mounting plate and a canopy coupled to said canopy mounting plate, and wherein said second portion is movably mounted to said canopy mounting plate.

11. The ceiling fan hanging system of claim 10 wherein said canopy mounting plate includes a movable slide and wherein said second portion is mounted to said slide.

12. The ceiling fan hanging system of claim 9 wherein said canopy assembly includes a movable slide and wherein said second portion is mounted to said slide.

13. The ceiling fan hanging system of claim 11 wherein said ceiling mounting plate includes at least one loop for engaging contact with said slide.

14. The ceiling fan hanging system of claim 10 wherein said ceiling mounting plate includes at least one mounting hook and wherein said canopy mounting plate includes at least one hook receiver configured to receive said mounting hook.

* * * * *